US006335662B1

(12) United States Patent
Del Rosario, Jr. et al.

(10) Patent No.: US 6,335,662 B1
(45) Date of Patent: Jan. 1, 2002

(54) FERROELECTRIC-TUNABLE MICROWAVE BRANCHING COUPLERS

(75) Inventors: Romeo D. Del Rosario, Jr., Baltimore; Steven C. Tidrow, Silver Spring, both of MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/405,303

(22) Filed: Sep. 21, 1999

(51) Int. Cl.[7] ..... H01P 5/04; H01P 5/12

(52) U.S. Cl. ..... 333/111; 333/116; 333/128; 333/136

(58) Field of Search ..... 333/111, 116, 333/115, 109, 125, 128, 136

(56) References Cited

U.S. PATENT DOCUMENTS 3,560,891 A * 2/1971 MacLeay et al. ..... 333/116 X
4,313,095 A * 1/1982 Jean-Frederic ..... 333/116
5,349,364 A * 9/1994 Bryanos et al. ..... 333/116 X
5,496,796 A * 3/1996 Das ..... 333/99 X

* cited by examiner

*Primary Examiner*—Benny Lee
(74) *Attorney, Agent, or Firm*—Paul S. Clohan, Jr.; William V. Adams

(57) ABSTRACT

The invention discloses the utilization of various transmission lines that entail a ferroelectric material as dielectric substrate to introduce an impedance shift by means of an externally applied d.c. bias, which alters the effective length between the input and output signals of the transmission lines of microwave couplers.

3 Claims, 8 Drawing Sheets

FERROELECTRIC-TUNABLE MICROWAVE BRANCHING COUPLERS

The invention described herein was made in the performance of official duties by an employee of the Department of the Army and may be manufactured, used, licensed by or for the Government for any governmental purpose without the payment of any royalty thereon.

BACKGROUND OF THE INVENTION 1.0 Field of the Invention

The present invention relates to microwave couplers and, more particularly, to microwave couplers having means for increasing and varying the range of operating frequencies by means of a voltage control (i.e. voltage tunable). Currently, there is a need for frequency agile materials and components used in a wide variety of applications from communication to radar and electronic countermeasures. This invention contributes to the pursuit of this technology.

2.0 Description of the Prior Art

Microwave couplers are junctions between different sections of transmission lines. They allow microwave radiation to be ducted from one portion of a circuit to another while maintaining amplitude, phase, and modulation integrity. For example, in a microwave transmission line connecting an RF generator to an antenna, a coupler(s) would routinely be placed in the line in order to measure the power being delivered to the antenna. The coupled microwave signal might be only a small fraction of the total power being delivered and might not be at the same phase as the signal transmitted to the antenna, however, these differences should be constant (at a given frequency) and easily characterized. The microwave couplers are fabricated in a predetermined manner so as to provide for a desired center operating frequency with some defined bandwidth, such as $f_{center}$=10 GHz with a 1 GHz bandwidth (i.e., 9.5 to 10.5 GHz). It is desired to provide means that increases the range of operating frequencies for the microwave couplers and, if desired, altering the characteristic impedance of the microwave couplers, while at the same time maintaining or even reducing the insertion loss or the return loss. All this being done while allowing for tunability of the operating frequency of the microwave coupler.

SUMMARY OF THE INVENTION

Accordingly, it is a primary object of the present invention to provide means for increasing the range of the operating frequencies of a microwave coupler.

It is another object of the present invention to provide means for altering the characteristic impedance of the microwave coupler.

It is yet another object of the present invention to provide for tunability of the microwave coupler, while at the same time providing a broader range of operating frequencies for the microwave coupler.

It is a further object of the present invention to provide for a tunable branchline coupler, a tunable Wilkinson divider, a tunable backward wave coupler, and tunable Lange couplers each tunable device having increased and adjustable frequency operating ranges.

In accordance with these and other objects, the invention provides for a coupler for transferring a RF signal and having at least one input and at least one output with the input receiving the RF signal. The coupler comprises a transmission line and a piece of ferroelectric material. The transmission line has at least one first section having a first effective length defined by a first quarter wavelength and at least one section serving as the output of the coupler. The piece of ferroelectric material is arranged so as to substitute for a normal substrate material under at least one first section and which alters the first effective length by means of an external d.c. bias so as to be defined by a second quarter wavelength.

BRIEF DESCRIPTION OF THE DRAWINGS

The foregoing objects and advantages of the present invention will be more fully understood from the following detailed description having reference to the appended drawings wherein.

DETAILED DESCRIPTION OF THE PREFERRED EMBODIMENTS

The present invention relates to microwave couplers and, more particularly, to microwave couplers having means for increasing and varying their range of operating frequencies by means of a control voltage (i.e., voltage-tunable). This tunability is accomplished by using a control voltage to alter the microwave couplers dielectric permittivity and consequently, their characteristic impedance without severely degrading other characteristics, such as insertion loss and return loss (input matching). To accomplish these improvements, the present invention utilizes a ferroelectric material that has the characteristic of a dielectric constant, which can be varied using an applied d.c. bias.

A ferroelectric can be defined as a dielectric with a spontaneous polarization that can be reversed in sign upon the application of an electric field. Many technologically important ferroelectric materials are found in the perovskite oxide, $ABO_3$ class of materials. Depending upon constituent atoms used in the structure, perovskite oxides have a wide variety of properties, such as superconductors, ferroelectrics, colossal magnetoresistors, dielectrics, conductors, semiconductors, etc. For ferroelectrics, the term ferro has been used because these materials are analogous in some ways to ferromagnetic materials. Ferroelectric materials below the Curie temperature, $T_c$ exhibit a hysteresis loop when plotting polarization ($C/cm^2$) versus applied electric field (V/cm), which is analogous to the hysteresis loop (B versus H) of ferromagnetic materials. The structure of a ferroelectric material becomes less distorted as the temperature increases. Ferroelectrics have many important device applications. Below $T_c$ the ferroelectric effect can be used for radiation-hard memory. The piezoelectric effect can be used for MEMs actuators and sensors. The pyroelectric effect can be used for uncooled IR detectors. Above $T_c$ the ferroelectric material is in the paraelectric regime, where the microwave dielectric losses are minimized while the dielectric constant can be changed with no hysteresis using an applied d.c. bias, such as used in the present invention. Thus, in the paraelectric regime, these materials can be used for phase shifters and other RF-tunable devices. The most popular ferroelectric material for RF phase shifters is $Ba_{1-x}Sr_xTiO_3$ (BST), where $x \leqq 1$. By using an appropriate value for x, the Curie temperature can be controlled in a linear manner. Vegard's type rule (known in the art), between the Curie temperature of $BaTiO_2$ ($T_c$=393K) and that of $SrTiO_3$ ($T_c$<70K). Typically, for phase shifters operating at room temperature, $0.4 \leqq x \leqq 0.6$ placing the Curie temperature, $175K \leqq T_c \leqq 250K$, for BST.

Figure 1:
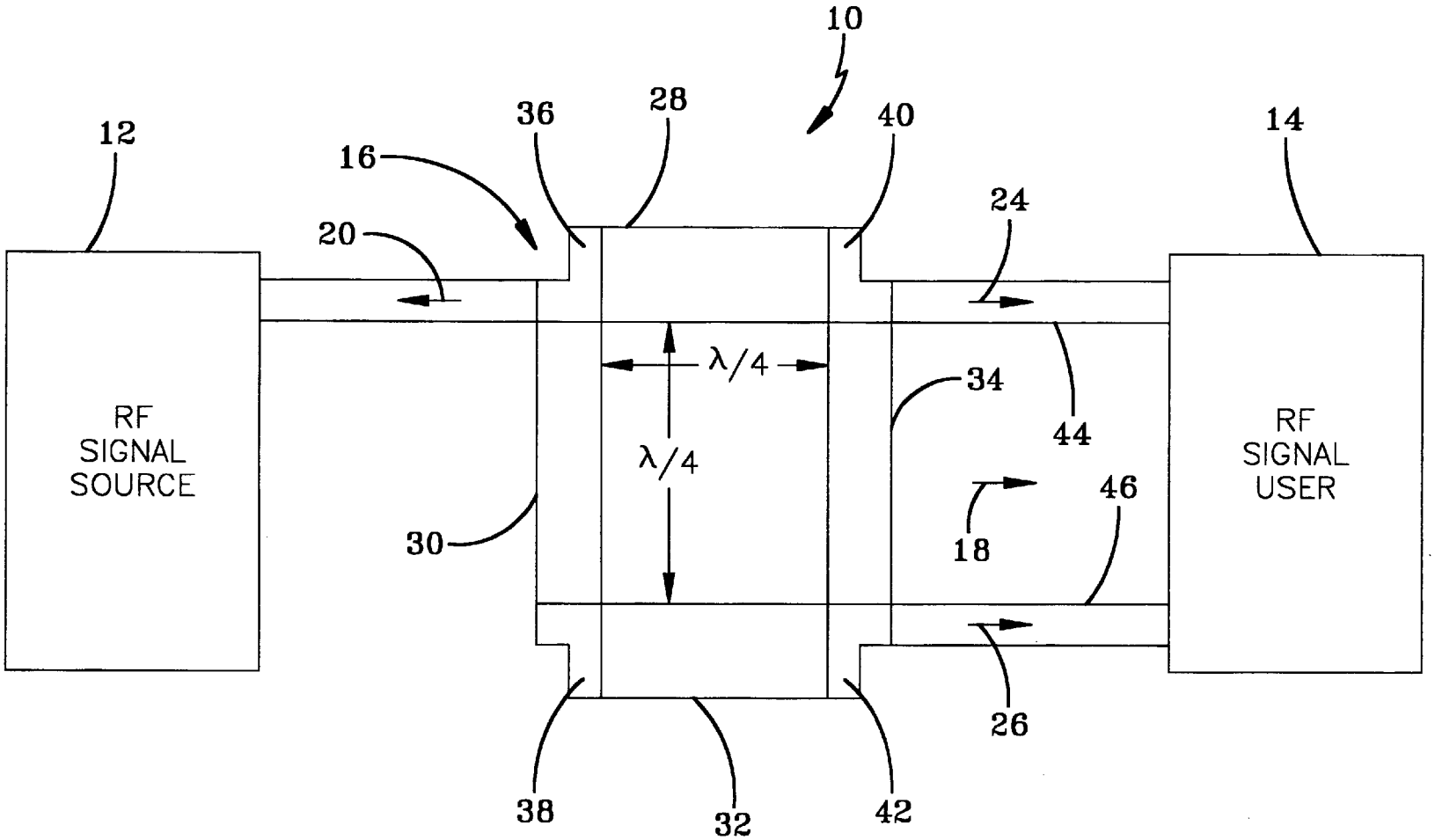
FIG-1 PRIOR ART
FIG. 1 schematically illustrates a prior art microwave coupler transferring energy between a RF signal source and a RF signal user.

In order that the inventive aspects of the present invention may be more fully appreciated, reference is first made to a prior art microwave coupler by referring to the drawings, wherein the same reference number indicates the same element throughout, and wherein FIG. 1 is a layout of a conventional branchline coupler 10 not having the benefits of the present invention.

The branchline coupler 10 is used to divide an input signal, generated by an RF signal source 12, into two (2) output signals, each at half of the original power, one in phase with the input signal, and one in quadrature (90 deg lag). These output signals may then be transmitted to some other part of the circuit, amplifier, antenna, etc. The branchline coupler 10 has an input stage 16 having a characteristic impedance, such as 50 ohms, which is the impedance that the RF signal source 12 "sees." The branchline coupler 10 has an output stage 18 that provides the transfer of the microwave energy to the RF signal user 14 as designated by the directional arrow. The branchline coupler 10 has a known insertion loss and a known return loss, wherein directional arrow 20 indicates a current that is returned from the branchline coupler 10 to the RF signal source 12 and directional arrows 24 and 26 indicate the flow of the current from the branchline coupler 10 to the RF signal user 14.

The branchline coupler 10 has two branches comprised of four side members 28, 30, 32 and 34 that are interconnected to each other by junction members 36, 38, 40 and 42. The output stage 18 of the branchline coupler is connected to the RF signal user 14 by conductive transmission lines 44 and 46.

Each of the sides 28, 30, 32 and 34 acts as a quarter wave ($\lambda/4$) transmission line, known in the art. When a transmission line is a quarter of a wavelength, the standing wave developed by feeding in a RF signal into a transmission line varies from a maximum at one end to a minimum at the other end, with no other maximum or minimum therebetween. As the frequency of the applied signal increases, the wavelength decreases. Thus, if a section of a line is a quarter wavelength at one frequency it can not be a quarter wavelength at any other frequency unless its physical length is changed, or the effective length is changed by the practice of the present invention. More particularly, the present invention provides for a branchline coupler 100 having an increased operating frequency yielded by reducing the effective length that defines the quarter wavelength ($\lambda/4$) characteristic and which may be further described with reference to FIG. 2.

Figure 2:
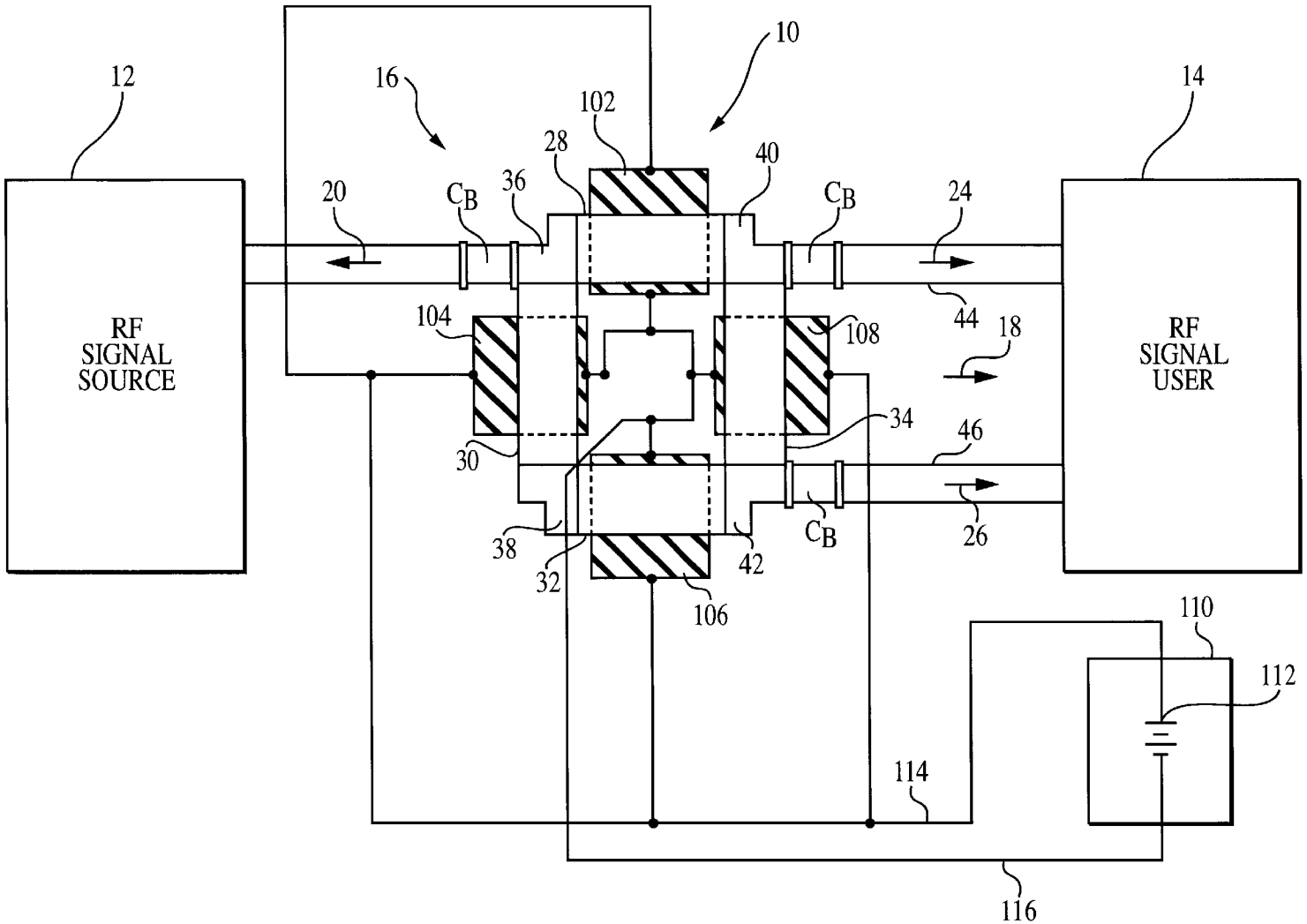
FIG. 2 illustrates one embodiment of the microwave coupler of the present invention that increases the operating frequency of the microwave coupler and that illustrates the use of an external source supplying a d.c. bias.

The branchline coupler 100 of the present invention is quite similar to the branchline coupler 10 of FIG. 1 and utilizes the same reference number to indicate the same elements therebetween, but in addition thereto comprises four pieces of ferroelectric material 102, 104, 106, and 108 that are respectively arranged around side members 28, 30, 32 and 34. The four (4) pieces of ferroelectric material 102, 104, 106, and 108 substitute for a normal substrate material found in the prior art branchline coupler 10. The ferroelectric material contained in pieces 102 and 106 are essentially the same and, similarly, the ferroelectric material contained in pieces 104 and 108 are essentially the same. Each of the ferroelectric pieces 102, 104, 106, and 108 serves as a permittivity/impedance shifter so as to change the effective length of those sections of transmission line between the RF signal appearing at the input stage 16 and existing at the output stage 18. The effect is that the coupler circuit is retuned to a different frequency because of the change in impedance and effective length. As previously discussed, the magnitude of change is effected by the d.c. bias applied to the ferroelectric pieces 102, 104, 106, and 108. The applied d.c. bias is schematically shown in FIG. 2 as an element 110 having a battery 112 with busses 114 and 116 applied to the ferroelectric pieces 102, 104, 106, and 108. This applied d.c. bias is also applicable to the other embodiments of the present invention, but not shown therefore for the sake of clarity. Further, as seen in FIG. 2 a blocking capacitor $C_B$ is placed at each of the junction members 36, 40 and 42, interchangeably referred to herein as tees, so as to keep the d.c. bias applied to the microwave couplers of the present invention from damaging the R.F. source, that is, RF signal source 12. The blocking capacitor $C_B$ is used for all embodiments of the present invention in a manner as shown for the respective illustrations thereof.

Another embodiment 200 of the present invention may be described with reference to FIG. 3. The embodiment 200 is a Wilkinson divider, known in the art, and which includes a prior art transmission line element 50 at its input stage 16A having a characteristic impedance of 50 ohms, a terminating resistor 52 having a typical value of 50 ohms at its output stage 18A, and two output transmission lines 54 and 56 respectively connected to outputs 14 and 48 respectively labled output #1 and output #2. Further, the Wilkinson divider 200 of the present invention comprises a member 58 which is C-shaped in cross-section and having an upper section 60 and a lower section 62.

Figure 3:
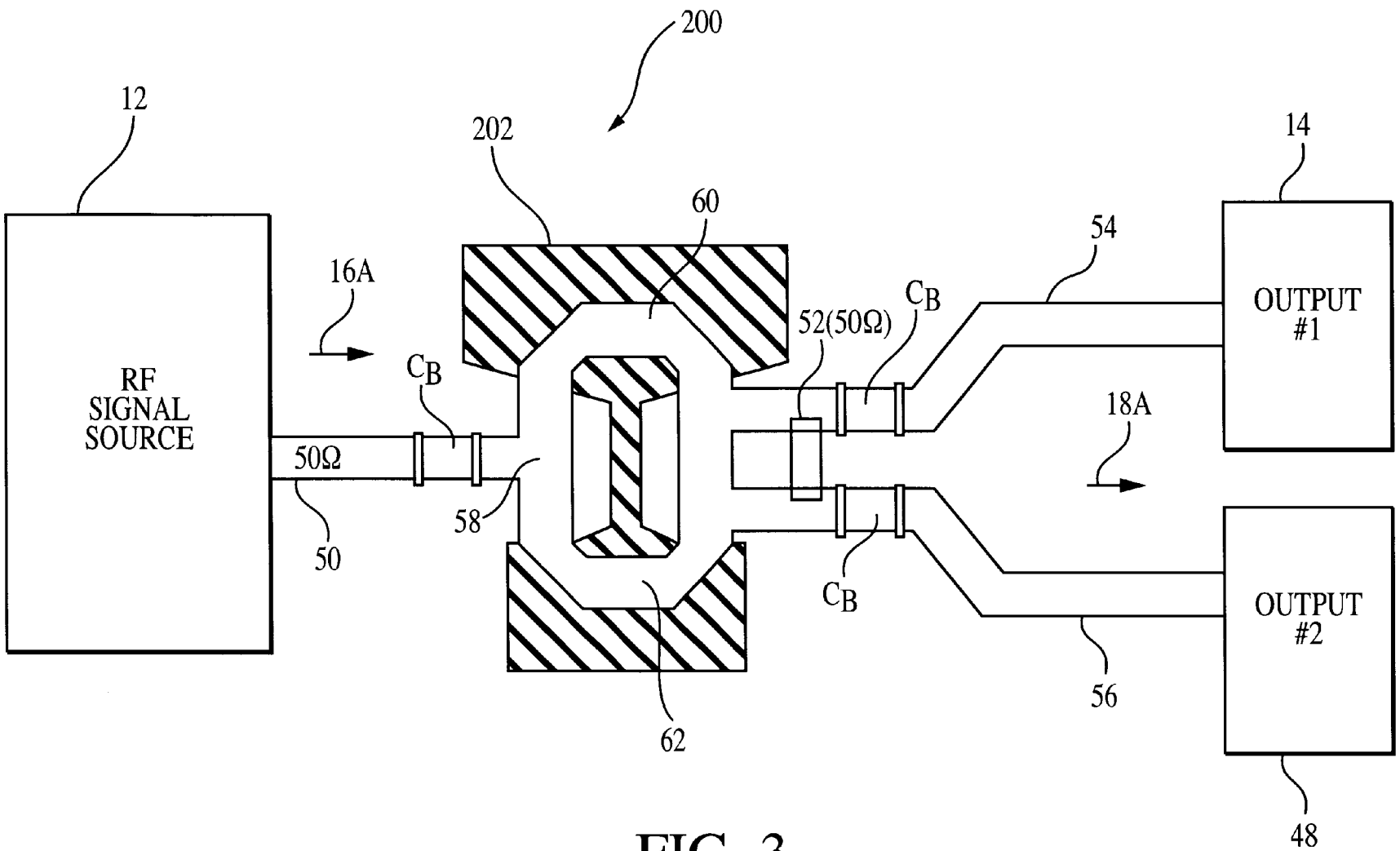
FIG. 3 illustrates a second embodiment of a microwave coupler in accordance with the practice of the present invention.

The Wilkinson divider 200 comprises a piece of ferroelectric material 202 which surrounds the upper and lower sections 60 and 62 of the C-shaped member 58 as shown in FIG. 3. The ferroelectric material 202 operates in the same manner as previously described for ferroelectric materials 102, 104, 106 and 108 of the FIG. 2 embodiment so as to alter the effective length, more particularly, the quarter wavelength ($\lambda/4$) transmission line parameter associated with the coupler 200. The altering of the quarter wavelength is accomplished so as to decrease the operating wavelength which, in turn, increases the operating frequency at which the Wilkinson divider 200 of the present invention performs successfully.

Figure 4:
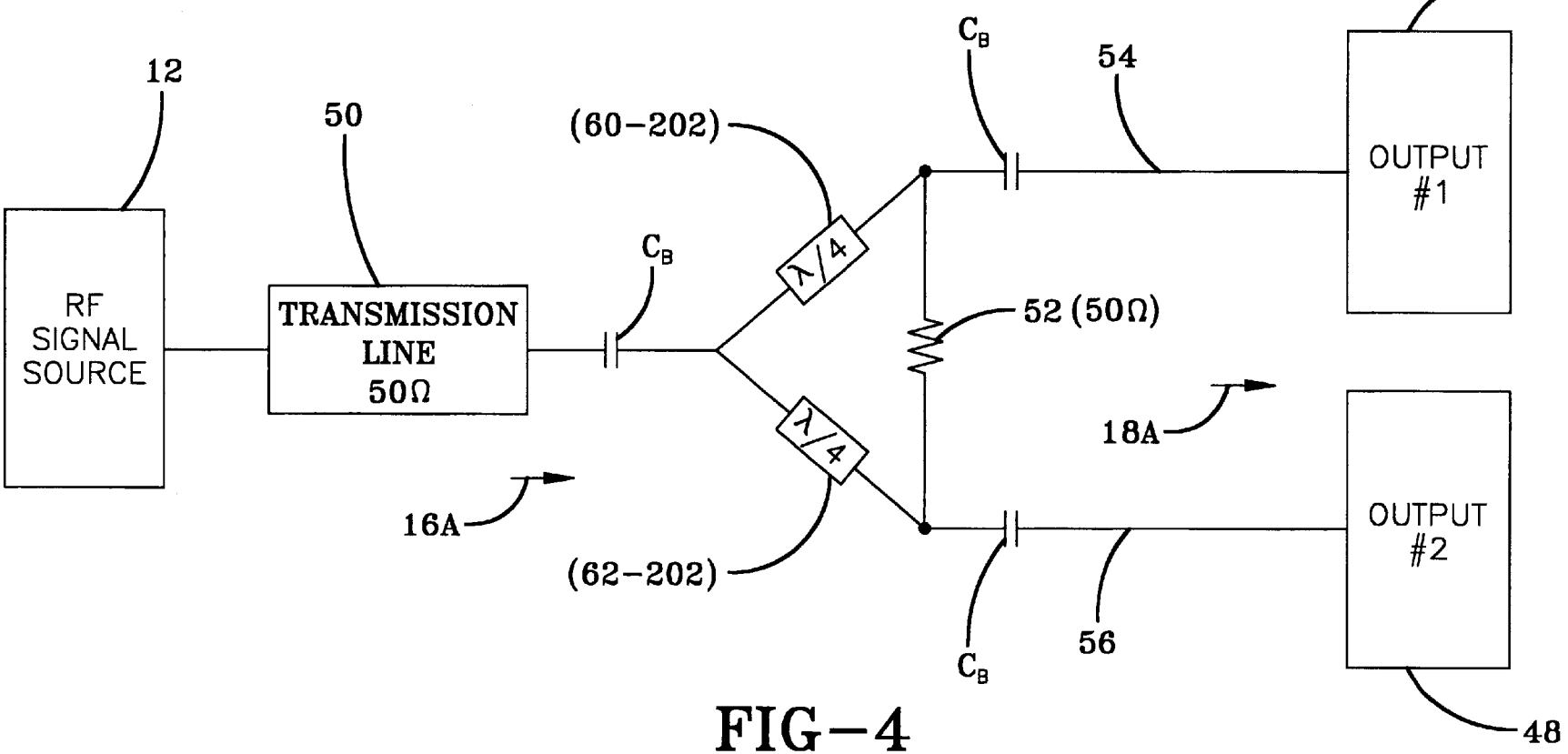
FIG. 4 schematically illustrates the operation of the present invention that is used to alter the characteristic impedance of the microwave coupler in accordance with the practice of the present invention.

The Wilkinson divider 200 of the present invention may also be used to alter the characteristic impedance at which it operates and may be further described with reference to FIG. 4. FIG. 4 illustrates the terminating resistor 52 connected across a pair of transmission lines, with the first transmission line made up of elements 60 and 202 and the second transmission line made up of elements 62 and 202. By altering the length of the quarter wavelength ($\lambda/4$), that is, by adding the ferroelectric material 202, the equivalent impedance for transferring energy from the input stage 16A to the output stage 18A may also be altered. More particularly, the elements 60–202 and 62–202 may be treated as legs of a network in which an input signal is applied to the input stage 16A having an impedance of 50 ohms and the output signal is taken off of the terminating resistor 52 also having an impedance of 50 ohms. The level or amount of the output RF signal appearing across the terminating resistor 52 is determined by the impedance of each of the legs 60–202 and 62–202 which, in turn, is determined by the effective length of the quarter wavelength ($\lambda/4$) which, in turn, is determined by the amount of ferroelectric material of element 202.

Figure 5:
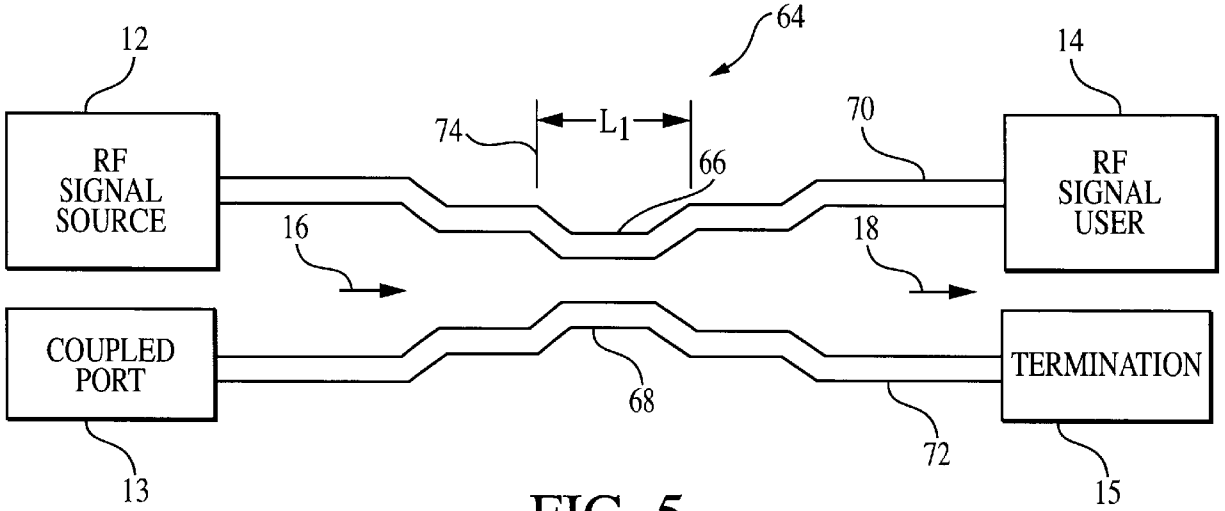
FIG. 5 PRIOR ART
FIG. 5 illustrates a prior art microwave coupler.

A further embodiment of the present invention related to a backward wave coupler, sometimes referred to as a parallel coupler, may be further described by first referring to FIG. 5 showing a prior art backward wave coupler 64. FIG. 5 schematically illustrates a backward wave coupler 64 as comprised of at least first and second sections 66 and 68, each of which run in parallel with each other and each of which have an effective length 74 of $L_1$ The first and second sections are respectively interrelated to transmission lines 70 and 72. The first section 66 is connected to the RF signal source 12, the second section 68 is connected to a coupled port element 13, the transmission line 70 is connected to RF signal user 14, and the transmission line 72 is connected to a termination element 15. The effective length 74 of $L_1$ is of importance and may be increased by the practice of the present invention to a quantity 304 of $L_2$ which may be described with reference to FIG. 6.

Figure 6:
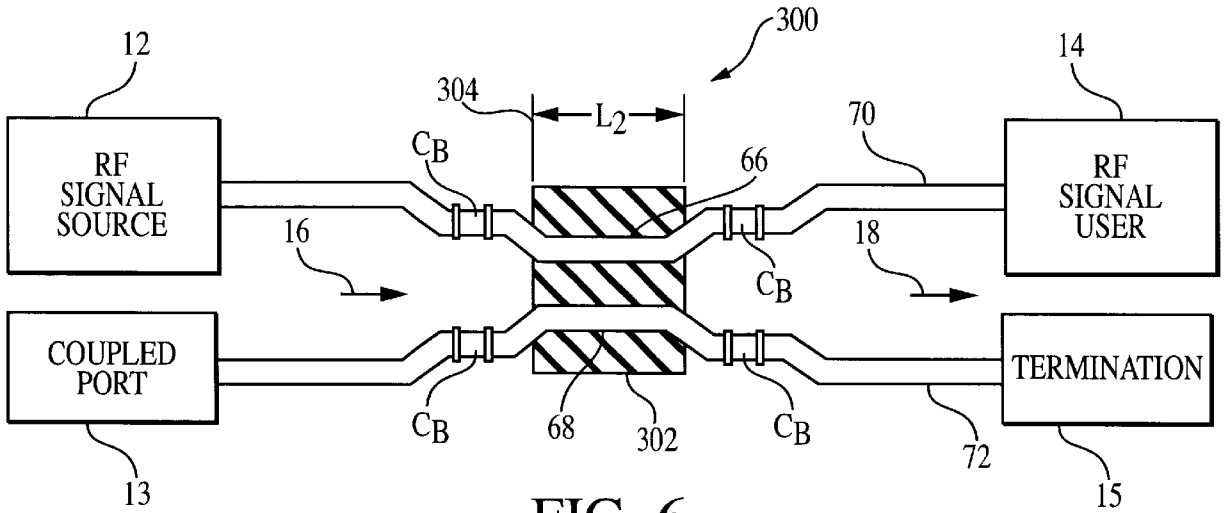
FIG. 6 illustrates another embodiment of the present invention related to a backward wave coupler.
Figure 7:
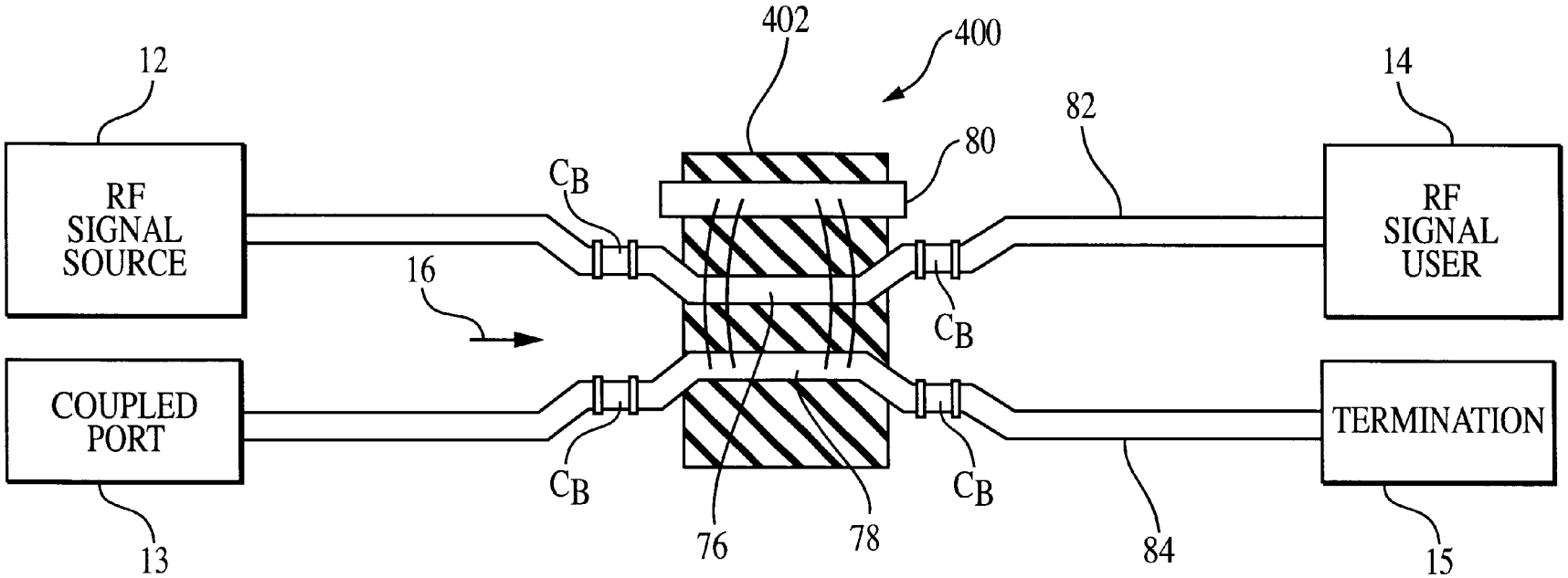
FIG. 7 illustrates another embodiment of the present invention related to a Lange coupler.

FIG. 6 illustrates a backward wave coupler 300 of the present invention comprised of the elements shown in FIG. 5 having the same reference numbers thereof, but in addition thereto, includes a piece of ferroelectric material 302 that is arranged to surround the first and second sections 66 and 68. The ferroelectric material 302 operates in the same manner as described for the ferroelectric materials of FIGS. 2 and 4 so as to increase the effective length from $L_1$, (shown as 74 in FIG. 5) to $L_2$ (shown as 304 in FIG. 6). The effective length $L_2$ of FIG. 6 is increased relative to the effective length $L_1$ of FIG. 5 which, in turn, increases the quarter wavelength dimension of the backward wave coupler 300 which, in turn, decreases the operating frequency of the backward wave coupler 300 relative to that of the backward wave coupler 64.

In the practice of the invention computer aided design (CAD) simulation utilizing Ansoft Corporation "Serenade" microwave circuit simulation software (known in the art) was employed and may be further described with reference to FIGS. 8 and 9.

Figure 8:
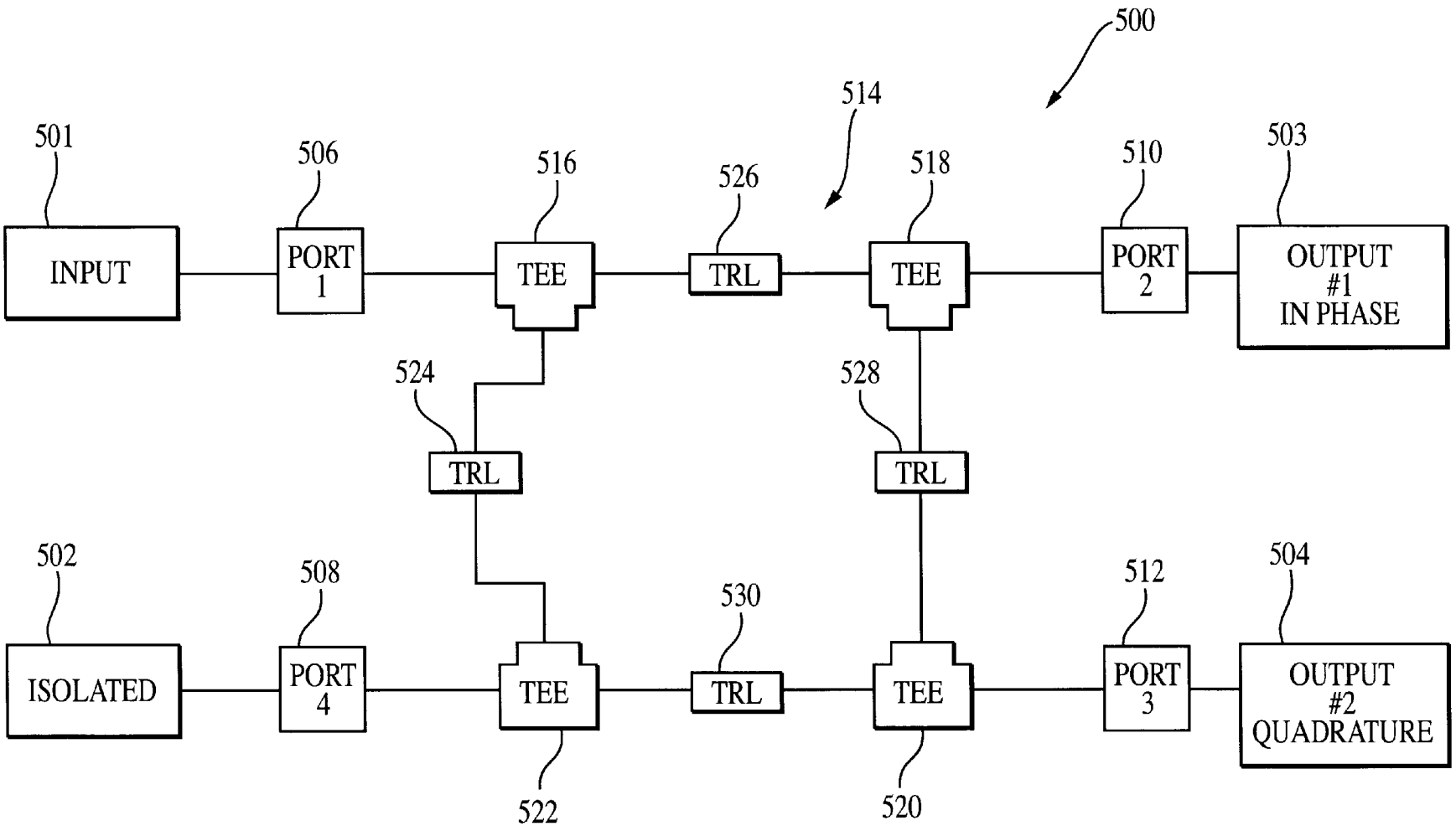
FIG. 8 illustrates a schematic depiction of an embodiment of present invention utilizing Ansoft Corp. "Serenade" microwave circuit simulation software (known in the art) for the branchline coupler of FIG. 2 enhanced with ferroelectric material.

FIG. 8 illustrates a simulation arrangement 500 having an input 501 that is provided with the frequencies starting at 15 GHz and ending at 100 MHz, with incremental size frequencies being 5 GHz. The arrangement 500 has the input 501, an isolated element 502, an output 503 having in phase components, and an output 504 having quadrature components respectively connected to ports 1, 4, 2 and 3 identified by reference numbers 506, 508, 510 and 512.

FIG. 8 further has an arrangement 514 which represents a schematic for a standard branchline coupler comprised of tees 516, 518, 520 and 522, respectively arranged in a clockwise manner, with tee 516 connected to port 1 (506), tee 518 connected to port 2 (510), tee 520 connected to port 3 (512) and tee 522 connected to port 4 (508). The tees 516, 518, 520 and 522 serve as junctions, as shown in FIG. 8, between circuit sections 524, 526, 528, and 530.

The enhancement provided by the present invention is comprised of the circuit sections 524, 526, 528 and 530 labeled as "trl" and that use a substrate material different from the normal substrate material. The different substrate material has been previously described as being a ferroelectric material. In the simulation of present invention, the dielectric permittivity was varied between 2.33 and 3.11 in order to simulate the performance of the branchline coupler of FIG. 2 enhanced by the ferroelectric material.

Figure 9:
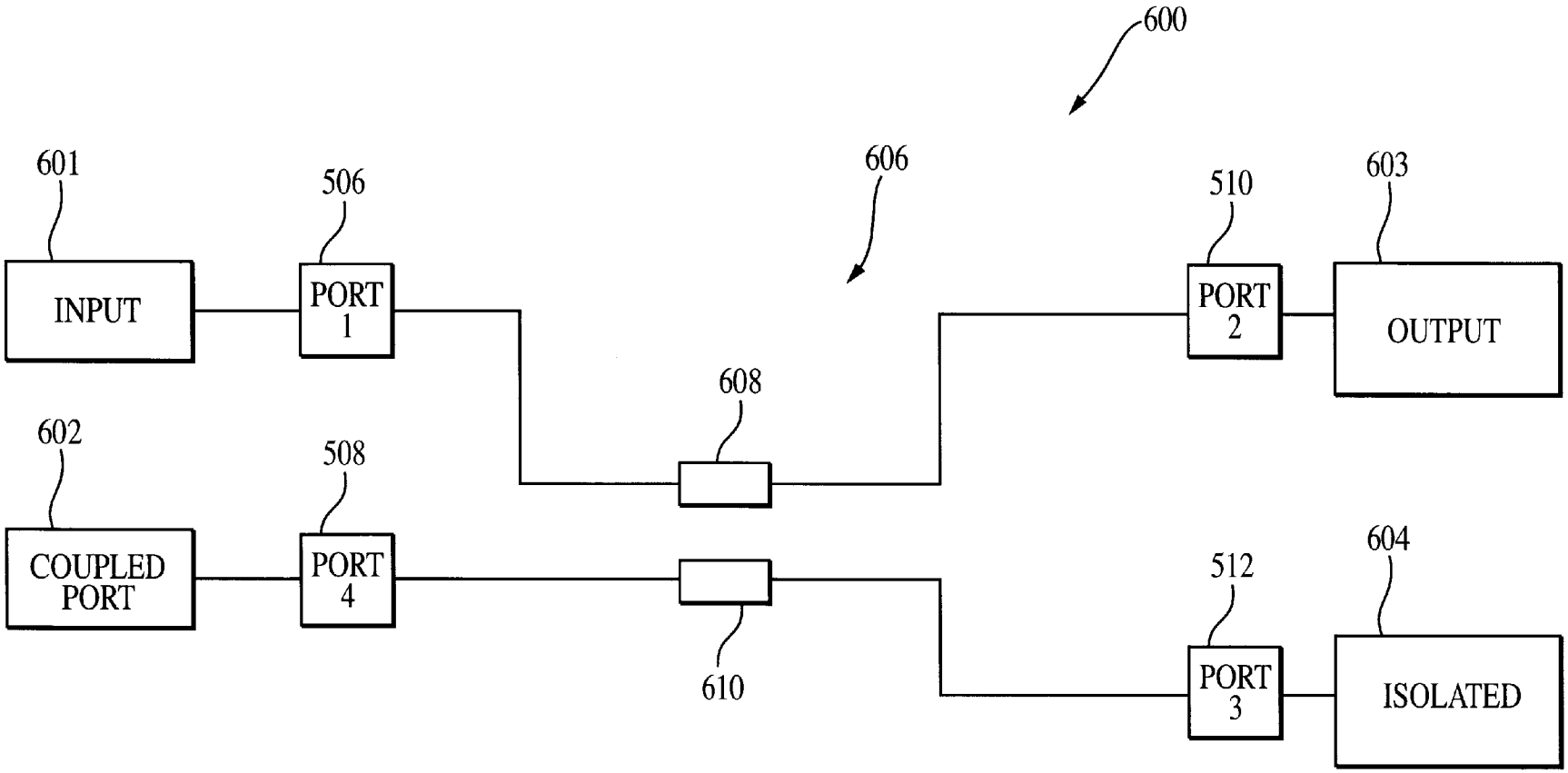
FIG. 9 illustrates a schematic depiction of another embodiment of present invention utilizing Ansoft Corp. "Serenade" microwave circuit simulation software (known in the art) for the parallel line or backward wave coupler of FIG. 6 enhanced with ferroelectric material.

FIG. 9 illustrates a simulation arrangement 600 having an input 601 providing the same inputs as input 501 of FIG. 8. The arrangement 600 has the input 601, a coupled port 602, an output 603, and an isolated element 604 respectively connected to ports 1, 4, 2 and 3 (already described with reference to FIG. 8) identified by reference number 506, 508, 510 and 512.

FIG. 9 is analagous to FIG. 8 in most respects except the parallel line or backward wave coupler of FIG. 9, generally indicated by reference number 606 itself consists of a pair of coupled transmission lines 608 and 610 with varying substrate, that is, the varying substrate material, similar to the circuit sections 524, 526, 528 and 530 of FIG. 8. Any transmission lines external to this coupler would be assumed to have a constant dielectric as found in a normal substrate. Simulation was again performed in accordance with the embodiment 600 of the present invention and the results of the simulation showed that the maximum coupling ($S_{21}$) (known in the art) varied from 10.10 GHz to 9.4 GHz while the dielectric constant of transmission lines 604 and 606 was varied from 2.33 to 3.11.

In accordance with the practice of the present invention, and with reference to the arrangement 500 of FIG. 8, further computer simulation was performed and the results of the simulation showed a change in center frequency from 9.6 GHz to 8.5 GHz as measured from the point of maximum coupling (i.e. coupling or S21 was measured and plotted vs the aforementioned frequencies). Likewise, the minimum reflection coefficient (S11, and indicator of the quality of the impedance match) varied from 9.8 to 8.7 GHz. This clearly demonstrates proof of the principle of the present invention with a tunability of about 9%. In addition, phase measurements were taken and demonstrated no additional variation in the 90 degree phase difference between ports 2 and 3 after varying the dielectric constant.

It should now be appreciated that the practice of the present invention provides for microwave couplings having an increased or decreased operating frequency which are achieved by providing a piece of ferroelectric material around each of the quarter wavelength transmission line members of conventional microwave couplers.

Various additional modifications will become apparent to those skilled in the art, all such variations which basically rely on a teaching to which this invention is advanced to the art are properly considered within the scope of this invention.

We claim:

1. A coupler for transferring an RF signal and having at least one input and at least one output with each of said inputs receiving said RF signal, said coupler comprising;

a transmission line having at least one first section having a substrate material with a first effective length defined by a first quarter wavelength, and at least one section serving as at least one of said outputs of said coupler;

at least one piece of ferroelectric material arranged in addition to said substrate material under said at least one first section and which alters said first effective length by means of an external d.c. bias resulting in a second quarter wavelength;

wherein said second quarter wavelength is either greater than or less than said first quarter wavelength depending on the magnitude of said external d.c. bias; and wherein said transmission has the form of a Lange coupler having a central portion with first, second, and third sections with the first and second sections running parallel to each other and with the third section arranged so as to provide electromagnetic coupling between itself and one of said first and second sections, said piece of ferroelectric material surrounding said first, second and third sections.

2. A coupler for transferring an RF signal and having at least one input and at least one output with each of said inputs receiving said RF signal, said coupler comprising;

a transmission line having at least one first section having a substrate material with a first effective length defined by a first quarter wavelength, and at least one section serving as at least one of said outputs of said coupler;

at least one piece of ferroelectric material arranged in addition to said substrate material under said at least one first section and which alters said first effective length by means of an external d.c. bias resulting in a second quarter wavelength;

wherein said second quarter wavelength is either greater than or less than said first quarter wavelength depending on the magnitude of said external d.c. bias; and wherein said transmission line has the form of a Wilkinson divider having one input branch and two output branches with the output branches having a terminating resistor thereacross, said input branch and said two output branches being interconnected by a member having a C-shaped cross-section and having upper and lower sections and with each said piece of ferroelectric material surrounding said upper and lower sections of said C-shaped member.

3. A coupler for transferring an RF signal and having at least one input and at least one output with each of said inputs receiving said RF signal, said coupler comprising;

a transmission line having at least one first section having a substrate material with a first effective length defined by a first quarter wavelength, and at least one section serving as at least one of said outputs of said coupler;

at least one piece of ferroelectric material arranged in addition to said substrate material under said at least one first section and which alters said first effective length by means of an external d.c. bias resulting in a second quarter wavelength;

wherein said second quarter wavelength is either greater than or less than said first quarter wavelength depending on the magnitude of said external d.c. bias; and wherein said transmission line has the form of a branch line coupler having two branches comprised of four interconnected side members and with each said piece of ferroelectric material having the same dimensions and each arranged so as to surround a respective interconnected side member.

* * * * *